United States Patent [19]

Kumada et al.

[11] Patent Number: 4,872,924

[45] Date of Patent: Oct. 10, 1989

[54] METHOD OF PRODUCING SHADOW MASK OF COLOR CATHODE RAY TUBE

[75] Inventors: Masaharu Kumada; Akira Misumi, both of Mobara, Japan

[73] Assignee: Hitachi, Ltd., Tokyo, Japan

[21] Appl. No.: 85,763

[22] Filed: Aug. 17, 1987

[30] Foreign Application Priority Data

Sep. 12, 1986 [JP] Japan ..... 61-213834
Sep. 12, 1986 [JP] Japan ..... 61-213835

[51] Int. Cl.[4] ..... C21D 7/14

[52] U.S. Cl. ..... 148/12.1; 148/12.3; 148/12.7 N; 148/328; 148/333; 148/336; 148/410

[58] Field of Search ..... 148/11.5 N, 12.1, 12.3, 148/12.7 N, 6.35, 142, 162, 328, 333, 336, 410

[56] References Cited

U.S. PATENT DOCUMENTS 3,705,827 12/1972 Muzyka et al. ..... 148/142
4,536,226 8/1985 Ohtake ..... 148/12.1
4,612,061 9/1986 Suzuki et al. ..... 148/6.35
4,665,338 5/1987 Inaba et al. ..... 313/402

FOREIGN PATENT DOCUMENTS 2139424 12/1972 France .
59-105243 7/1982 Japan .
60-119059 11/1983 Japan .
59-59861 4/1984 Japan .
175535 10/1984 Japan ..... 148/6.35
61-183443 8/1986 Japan .
352964 2/1929 United Kingdom .
2075556 8/1981 United Kingdom .

*Primary Examiner*—R. Dean
*Attorney, Agent, or Firm*—Antonelli, Terry & Wands

[57] ABSTRACT

A method of producing a shadow mask for use in a color cathode ray tube, has the following steps which are conducted in sequence: preparing an alloy sheet having a composition consisting of 30 to 50 wt % of Ni, 1 to 5 wt % of Ti and the balance substantially Fe and incidental impurities; perforating the alloy sheet by etching; subjecting the etched alloy sheet to a solution heat treatment; forming the alloy sheet after the solution heat treatment into a predetermined form; subjecting the formed alloy sheet to an age-hardening treatment by holding the alloy sheet within a non-oxidizing atmosphere at a temperature ranging between 650° and 750° C.; and subjecting the alloy sheet after the solution heat treatment to a surface blackening treatment thereby forming a black film on the surface of the alloy sheet.

12 Claims, 2 Drawing Sheets

METHOD OF PRODUCING SHADOW MASK OF COLOR CATHODE RAY TUBE

BACKGROUND OF THE INVENTION

The present invention relates to a method of producing a shadow mask for use in a color cathode ray tube.

In general, a shadow mask for use in a color cathode ray tube has a multiplicity of minute holes arranged regularly. In operation of such a color cathode ray tube, less than one-third ($\frac{1}{3}$) of the emitted electron beams can pass through these minute holes, while other portions of the electron beams are made to collide with the structural portions of the shadow mask. In consequence, the temperature of the shadow mask is raised with the result that the color purity is degraded due to a thermal distortion of the shadow mask.

Under these circumstances, various studies and proposals have been made in order to suppress any deviation of beams caused by thermal distortion of the shadow mask. For instance, it has been proposed to use, as the material of a shadow mask, an Fe-Ni alloy, which has a small thermal expansion coefficient so as to reduce the thermal distortion of the shadow mask, as shown in Japanese Unexamined Patent Publication No. 59861/1984.

It is true that shadow masks made of conventional Fe-Ni alloys exhibit small amounts of thermal distortion, but are inferior in the mechanical strength. In consequence, the shadow masks made of such materials tend to be deformed in the course of manufacture of the shadow mask or in the subsequent assembly of cathode ray tubes, as well as during handling or transportation, with the result that the color purity is impaired undesirably.

These have been also made various proposals and attempts such as an improvement in the structural design of the shadow mask, construction for mounting the shadow mask on a mask support, and so forth. Unfortunately, all these attempts and proposals are still unsatisfactory and cannot provide any appreciable effect.

SUMMARY OF THE INVENTION

Accordingly, an object of the present invention is to provide a method of producing a shadow mask of a color cathode ray tube which makes it possible to produce a shadow mask in which both an improved mechanical strength and a reduced thermal expansion are attained simultaneously.

To this end, according to one aspect of the present invention, there is provided a method of producing a shadow mask for use in a color cathode ray tube, having the following steps which are conducted in sequence: preparing an alloy sheet having a composition consisting of 30 to 50 wt % of Ni, 1 to 5 wt % of Ti and the balance substantially Fe and incidental impurities, perforating the alloy sheet by etching; subjecting the etched alloy sheet to a solution treatment; forming the alloy sheet after the solution treatment into a predetermined form; subjecting the formed alloy sheet to an age-hardening treatment by holding the alloy sheet within a non-oxidizing atmosphere at a temperature ranging between 650° and 750° C.; and subjecting the alloy sheet after the age-hardening treatment to a surface blackening treatment thereby forming a black film on the surface of the alloy sheet.

The age-hardening treatment and the surface blackening treatment may be conducted simultaneously.

Preferably, the non-oxidizing atmosphere is of a mixture of nitrogen gas and hydrogen gas, or of a hydrogen gas, or of a vacuum.

According to this method, an intermetallic compound of Ni and Ti is precipitated during the age-hardening to enhance the mechanical strength of the alloy plate, that is, the 0.2% yield strength thereof is not less than 45 Kgf/mm$^2$, the hardness thereof being not less than 200 Hv, the thermal expansion coefficient thereof defined in a range of 20° to 100° C. being not more than $4.00\times10^{-6}$/°C.

DESCRIPTION OF THE PREFERRED EMBODIMENTS

(First Embodiment)

Alloy sheets of 0.13 mm thick were prepared from alloys having compositions of working examples 1 to 3 shown in Table 1. The sheets were perforated by etching so as to have a multiplicity of minute holes of 0.090 mm in diameter at a pitch of 0.40 mm, whereby blank plates of shadow mask were formed. Then, a solution treatment was effected regarding the blank plates by maintaining these blank plates for 1 hour at 1000° C. within an atmosphere of a mixture of nitrogen gas and hydrogen gas. This solution heat treatment is conducted for the purpose of reducing the 0.2% proof stress to a level suitable for press working. The thus treated blank plates were then pressed into the form of a shadow mask for 15-inch TV screen. Three sample shadow masks were thus prepared for each of the three working examples.

These samples were subjected to an age-hardening treatment by being held at 650° C. for 0.5 hour within a non-oxidizing atmosphere. Finally, a surface blackening treatment was conducted on the samples by holding the hardened samples at 600° C. within an atmosphere of a mixture gas (a dew point of 20° C.) of both $H_2$ and steam.

The age-hardening treatment causes precipitation of intermetallic compounds expressed by NixTiy. The surface blackening treatment is intended for improving radiation of heat which is generated as a result of collision by electron beams. The surface blackening is conducted by preferential oxidation of titanium which oxidation occurs because of the steam in the mixture gas.

As a result of oxidation, Ti becomes to exhibit a dark blue color which makes the surface of the shadow mask exhibit black color. In general, oxidation of Fe requires a high oxidizing temperature, as well as a complicated control of the oxidizing condition. In contrast, Ti can be oxidized without difficulty. In addition, the oxides of Ti are dense and stable, and have a large adhesive strength. Thus, the Ti oxides are less liable to change its nature and exhibits small tendency of being peeled off the substrate during handling and during the use of the product.

On the other hand, however, Ti oxides only have a small electric conductivity, which leads to a fear that Ti oxides may be electrostatically charged as it is collided by electron beams. However, experiments conducted by the inventors have proved that the low electrical conductivity does not significantly affect the quality of the product.

TABLE 1

| Working Examples | Contents of Added Elements (wt %)* | | After age-hardening | | Thermal expansion coefficient (20–100° C.) |
|---|---|---|---|---|---|
| | Ni | Ti | 0.2% proof stress (Kgf/mm²) | Hardness (Hv) | (× $10^{-6}$/°C.) |
| 1 | 38.9 | 1.6 | 45.3 | 201 | 3.05 |
| 2 | 40.8 | 2.4 | 56.9 | 223 | 3.28 |
| 3 | 42.7 | 4.0 | 68.3 | 264 | 3.96 |

*The balance is Fe and incidental impurities.

In regard to the working examples of the material compositions, the balance is Fe and incidental impurities in all of these working examples.

Figure 1:
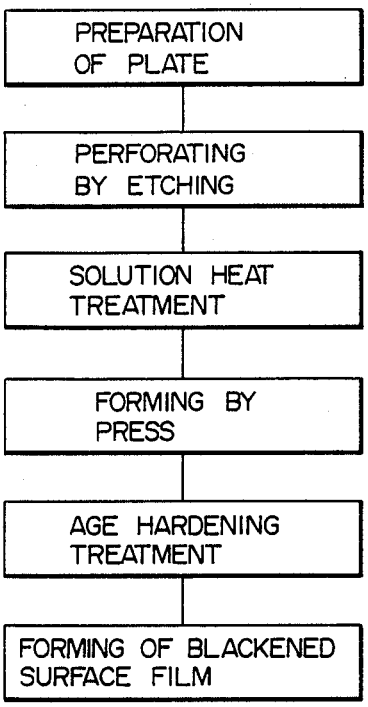
FIG. 1 is an illustration of steps of a first embodiment of the production method of the present invention.

The process explained before is shown in the form of a flow chart in FIG. 1. Shadow mask assemblies as shown in FIG. 3 were formed from the shadow mask samples prepared by the process explained before.

Figure 3:
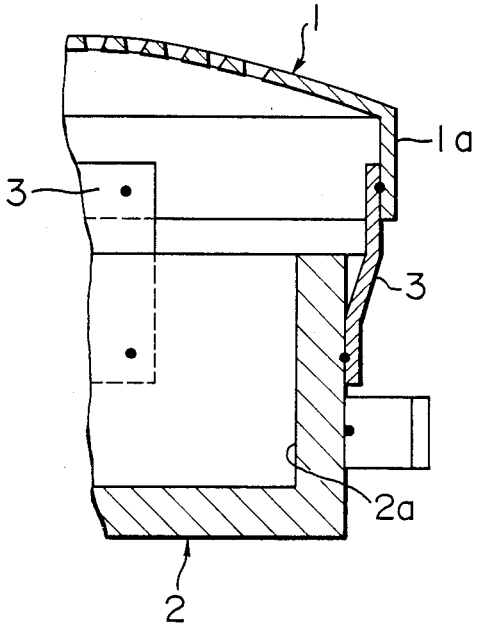
FIG. 3 is a sectional view of a shadow mask assembly.

As will be seen from FIG. 3, the shadow mask was not directly attached to a vertical flange 2*a* of a mask support 2 but was spot-welded to the vertical flange 2*a* through an intermediate member 3. This arrangement is effective in reducing the tendency for the shadow mask to be deformed by the mask support 2 due to a difference in the thermal expansion coefficient between the materials of the shadow mask 1 and the mask support 2. The intermediate member 3 was formed from a stainless steel and was 0.15 mm thick, 30 mm long and 18 mm wide. Two pieces of such intermediate member were used for each longer side of the shadow mask 1 and a single piece of intermediate member was used for the shorter side of each shadow mask 1. The mask support was prepared from a soft steel sheet of 1.6 mm thick.

Color cathode ray tubes were fabricated in a manner known per se, using the thus obtained shadow mask assemblies. A test was conducted for the purpose of examining the strength of the shadow mask, by fitting the color cathode ray tubes in wood boxes and dropping the box from a height of 30 cm. None of the tested cathode ray tubes showed deformation of the shadow mask.

The same strength test was conducted on color cathode ray tubes which employed shadow mask blank plates as specified in Table 2. The cathode ray tube employing the blank plate of comparison example 2, which was made from a Ni-Fe alloy of 0.13 mm thick, showed wrinkle-like permanent deformation and was practically unusable. On the other hand, the cathode ray tube employing the blank plate of comparison example 1 showed almost no deformation as in the case of the examples in accordance with the invention. The cathode ray tube prepared from the material of the comparison example 1, however, showed the following disadvantage when subjected to a test for examining electric characteristics. Namely, with this type of cathode ray tube, it was impossible to make the amounts of deviation of dome beam in the doming fall within a predetermined allowable range. In contrast, in the shadow masks prepared from the materials of the working examples 1 to 3, the amounts of deviation of electron beams were not greater than 50% of that exhibited by the shadow masks prepared from the materials of the comparison example 1. On the other hand, the shadow mask prepared from the material of the comparison example 2 showed an amount of beam deviation of not greater than 40% of that shown by the shadow mask prepared from the comparison example 1. This small amount of beam deviation is excellent but the shadow mask prepared from the comparison example 2 exhibits a large deformation when subjected to mechanical impact and, hence, is practically unusable as explained before.

TABLE 2

| | Shadow mask blank plate | Mechanical properties | | Thermal expansion coefficient (20–100° C.) |
|---|---|---|---|---|
| | | 0.2% Proof Stress (Kgf/mm²) | Hardness (Hv) | (× $10^{-6}$/° C.) |
| Comparison example 1 | 0.18 mm Soft steel plate | 11.4 | 92 | 12.0 |
| Comparison example 2 | 0.13 mm Invar plate (36.5% Ni—Bal.Fe) | 25.8 | 128 | 0.88 |

As will be clearly understood from Tables 1 and 2, the shadow masks produced from the working examples 1 to 3 in accordance with the first embodiment of the invented method are superior in the 0.2% proof stress in comparison with the shadow mask produced from conventionally used Ni-Fe alloy (comparison example 2). The mechanical strength in terms of hardness also is higher than that exhibited by the shadow mask produced from the Ni-Fe alloy. On the other hand, the shadow masks produced by the method of the invention from the working examples of the material exhibit much smaller values of thermal expansion coefficient than the shadow mask made from soft steel of the comparison example 1.

Ni constitutes the matrix of the shadow mask material together with Fe. The Ni content of the material of the shadow mask to be produced by the method of the invention preferably ranges between 30 and 50 wt %, more preferably between 35 and 45%, because such range of Ni content minimizes the thermal expansion coefficient of the alloy.

Ti is bonded to a part of Ni so as to allow precipitation of intermetallic compounds thereby enhancing the strength of the alloy. In order to attain an appreciable strengthening effect, the Ti content preferably is not smaller than 1 wt %. It is to be noted that any Ti content exceeding 5% will undesirably increase the thermal expansion coefficient and impairs the workability of the alloy.

According to the method of the invention, the material of the shadow mask may include elements other than Fe, Ni and Ti. For instance, addition of Cr in amount of not more than 2 wt % is rather preferred from the view point of improvement in the workability. On the other hand, the addition of Cr undesirably increases the value of the thermal expansion coefficient. The amount of addition of Cr, therefore, should be controlled strictly so as not to exceed the value of 2 wt %.

The solution treatment is preferably conducted at a temperature of between 850° and 1000° C. In order to obtain an appreciable effect, the solution treatment temperature should not be less than 850° C. Any solution treating temperature exceeding 1000° C. is not preferred because of the temperature of a risk for the surface of the product to be roughened undesirably.

On the other hand, the temperature at which the age-hardening is conducted preferably ranges between 650° and 750° C. The age-hardening conducted at a temperature below 650° C. cannot produce sufficient hardening effect. On the other hand, an age-hardening temperature exceeding 750° C. will cause an over-aging, with a result that the hardness is lowered. The period of time of the age-hardening is preferably between 30 minutes and 1 hour. The age-hardening may be conducted within a controlled atmosphere so that the age-hardening effect and surface blackening effect may be simultaneously obtained. It is, however, preferred that the age-hardening and the surface blackening are conducted independently so that these treatments may be carried out under the respective optimum treating conditions.

The atmosphere for the surface blackening treatment may be prepared from various gases such as $N_2$ gas, $Co_2$ gas, CO gas or their mixture, as well as $H_2$ gas used in the described embodiment. It is possible to conduct the blackening treatment under the optimum condition for obtaining the desirable blackened surface film, by a suitable control of the atmosphere.

(Second Embodiment)

Figure 2:
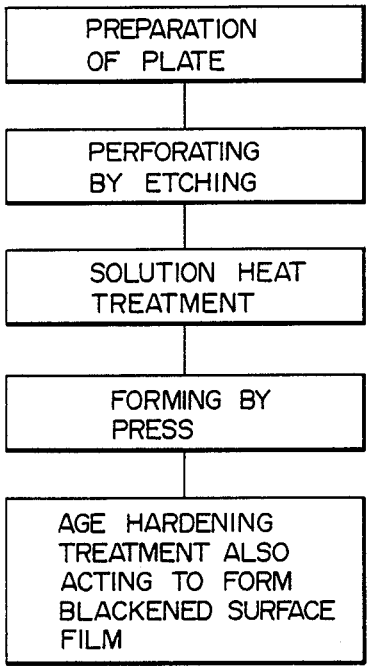
FIG. 2 is an illustration of steps of a second embodiment of the production method in accordance with the present invention.

Color cathode ray tubes were formed through a process which was carried out under the same conditions as the first embodiment, except that the surface blackening and aging hardening are conducted in a single step as shown in a flow chart in FIG. 2.

Namely, in the second embodiment, shadow mask blank plates were formed from the alloy sheets of the compositions of the working examples 1, 2 and 3 of the first embodiment through the same steps as the first embodiment. The thus prepared shadow mask blank plates were subjected to an age-hardening treatment by being held at 700° C. for 1 hour within an atmosphere of a mixture gas (having dew point of 20° C.) of hydrogen gas and steam.

The age-hardening causes the alloys to be hardened because of precipitation of NixTiy. At the same time, a film of black color is formed on the surface of each alloy as a result of oxidation of Ti. Thus, the age-hardening treatment in this case produces both a hardening effect and a blackening effect. The shadow masks after the treatment for the age-hardening and surface blackening showed 0.2% proof stresses and hardness which were of the substantially same levels as those in the first embodiment shown in Table 1.

Color cathode ray tubes were fabricated from these shadow masks through the same steps as the first embodiment and the thus fabricated color cathode ray tubes were tested by the same method as the first embodiment. The results were materially the same as those obtained with the first embodiment.

As will be understood from the foregoing description, according to the invention, it is possible to stably obtain shadow masks which have a small value of thermal expansion coefficient and which exhibits superior mechanical strength against mechanical impact which may be caused in the course of the production of the color cathode ray tubes or during the use of the same. In addition, the beam displacement caused by mask-doming is so small that the color purity and also the resolution can be improved remarkably when the shadow mask of the invention is used in a color cathode ray tube.

What is claimed is:

1. A method of producing a shadow mask for use in a color cathode ray tube, comprising the steps of: preparing an alloy sheet having a composition consisting of 30 to 50 wt % of Ni, 1 to 5 wt % of Ti, up to 2 wt % Cr and the balance substantially Fe and incidental impurities: perforating said alloy sheet by etching; subjecting the etched alloy sheet to a solution treatment at a temperature ranging between 850° and 1000° C.; forming the alloy sheet after the solution treatment into a predetermined form; subjecting the formed alloy sheet to an age-hardening treatment by holding said alloy sheet at a temperature ranging between 650° and 750° C.; and subjecting the formed alloy sheet to a surface blackening treatment so as to oxidize titanium of the composition of the alloy sheet, thereby forming a black film on the surface of said alloy sheet.

2. A method according to claim 1, wherein said age-hardening treatment and said surface blackening treatment are conducted simultaneously, within an atmosphere of a mixture gas of $H_2$ and steam or another mixture gas of $H_2$, $N_2$ and steam.

3. A method according to claim 1, wherein said solution treatment is carried out within the atmosphere of a mixture gas of nitrogen and hydrogen, or of a hydrogen gas, or of a vacuum.

4. A method according to claim 1, wherein said surface blackening treatment is conducted in an atmosphere of a mixture gas of $H_2$ and steam or another mixture gas of $H_2$, $N_2$ and steam.

5. A method according to claim 1, wherein said age-hardening is performed so as to provide a shadow mask having 0.2% proof stress of not smaller than 45 $Kgf/mm^2$, hardness of not lower than 200 Hv, and a thermal expansion coefficient at 20° to 100° C. of not more than $4.00\times10^{-6}/°C$.

6. A method according to claim 1, wherein said surface blackening treatment is conducted after the age-hardening treatment, and wherein the age-hardening treatment is carried out in a non-oxidizing atmosphere.

7. A method according to claim 6, wherein said surface blackening treatment is conducted in an atmosphere of a mixture gas of $H_2$ and steam, or another mixture gas of $H_2$, $N_2$ and steam.

8. A method according to claim 6, wherein the non-oxidizing atmosphere, in which the age-hardening treatment is carried out, is an atmosphere of a mixture gas of nitrogen and hydrogen, or an atmosphere of hydrogen, or an atmosphere of a vacuum.

9. A method according to claim 1, wherein the composition of the alloy sheet consists of 35 to 45 wt % of Ni, 1 to 5 wt % of Ti and the balance substantially Fe and incidental impurities.

10. A method according to claim 1, wherein the composition of the alloy sheet consists of 30–50 wt % of Ni, 1–5 wt % of Ti, and the balance substantially Fe and incidental impurities.

11. A method according to claim 2, wherein the age-hardening is conducted for a time ranging between 30 minutes and 1 hour.

12. A method according to claim 1, wherein the age-hardening is performed such that an intermetallic compound of Ni and Ti is precipitated so as to enhance the mechanical strength of the alloy as compared to that of the alloy without the intermetallic compound.

* * * * *